US006019637A

United States Patent [19]

Iwata et al.

[11] Patent Number: 6,019,637

[45] Date of Patent: Feb. 1, 2000

[54] CONTACT TERMINAL FIXING CONSTRUCTION

[75] Inventors: Yoshifumi Iwata; Hiroshi Watanabe, both of Shizuoka, Japan

[73] Assignee: Yazaki Corporation, Tokyo, Japan

[21] Appl. No.: 09/173,167

[22] Filed: Oct. 15, 1998

[30] Foreign Application Priority Data

Oct. 15, 1997 [JP] Japan ..... 9-282291

[51] Int. Cl.[7] ..... H01R 13/40

[52] U.S. Cl. ..... 439/595; 439/942

[58] Field of Search ..... 439/78, 79, 81, 439/82, 449, 862, 746, 942, 595, 493; 361/723, 752, 813

[56] References Cited

U.S. PATENT DOCUMENTS 4,037,898 7/1977 Guyette ..... 439/78
4,074,929 2/1978 Krider ..... 439/595
4,147,400 4/1979 Snyder ..... 439/78
5,030,136 7/1991 Reinhardt ..... 439/460

FOREIGN PATENT DOCUMENTS 2-47568 12/1990 Japan ..... H01R 13/42

*Primary Examiner*—Steven L. Stephan
*Assistant Examiner*—J. F. Duverne
*Attorney, Agent, or Firm*—Sughrue, Mion, Zinn, Macpeak & Seas, PLLC

[57] ABSTRACT

A contact terminal fixing construction including a first fixing portion and a second fixing portion which are mounted on a board in spaced relation to each other. When a distal end portion of a contact terminal is moved obliquely relative to the surface of the board, the first fixing portion engages this distal end portion. The second fixing portion includes a pair of claws, and a proximal end portion of the contact terminal is fitted into a space between these claws, and is engaged with the second fixing portion. The contact terminal has a limitation portion for limiting the movement of the contact terminal in a direction of a length thereof.

6 Claims, 7 Drawing Sheets

CONTACT TERMINAL FIXING CONSTRUCTION

BACKGROUND OF THE INVENTION

1. Field of the Invention

This invention relates to a contact terminal fixing construction in which a contact terminal can be mounted on a board without applying a load to the contact terminal.

2. Description of the Related Art

As shown in FIG. 6, a door 60 of an automobile comprises a door frame 61 for being opened and closed relative to a vehicle body (not shown), and a trim 62 to be mounted on that side (front side in the drawing) of the door frame 61 facing a passenger room.

A door-frame-side harness 63 is mounted on the door frame 61, and a casing 65 of a courtesy lamp 64 and a trim-side harness 67, connected to a switch panel 66, are mounted on the trim 62. The door-frame-side harness 63, the casing 65 and the trim-side harness 67 have strip-like contact terminals 68 of a predetermined length. The contact terminal 68 is formed, for example, by folding back a strip-like, flat metal member at a predetermined portion thereof, and the folded-back portion is formed into a substantially arcuate shape to serve as a spring portion.

In this door 60, when the trim 62 is mounted on the door frame 61, each of the contact terminals 68 is pressed against the associated contact terminal 68, and as a result the electrical connection to the courtesy lamp 64 and the switch panel 66 is made.

On the other hand, there has been proposed a connector housing (conventional construction; see Japanese Utility Model Examined Publication No. Hei. 2-47568) in which a terminal is inserted obliquely into a terminal receiving chamber, and then is pressed down, thereby retaining the terminal in a double manner.

In this conventional construction, by effecting the simple operation, that is, merely by inserting the terminal obliquely into the terminal receiving chamber and then by pressing down the terminal, the terminal can be retained in a double manner, and therefore there is obtained an advantage that the efficiency of the operation is greatly enhanced.

Incidentally, as shown in FIGS. 7(A) to 7(C), when the above connector housing 70 is used as a construction of fixing the contact terminal 68, the connector housing 70 is fixedly secured to a board, for example, in the casing 65 of the courtesy lamp 64, and the contact terminal 68 is inserted into the connector housing 70. In this case, however, during the insertion of the contact terminal 68 into the connector housing 70, the spring portion 69 of the contact terminal 68 is flexed by a wall 71 of the connector housing 70, which leads to a possibility that the contact terminal 68 is deteriorated or damaged.

SUMMARY OF THE INVENTION

With the above problem in view, it is an object of this invention to provide a contact terminal fixing construction in which a contact terminal can be fixedly mounted on a board without applying a load to the contact terminal.

According to the invention, there is provided a contact terminal fixing construction comprising a first fixing portion and a second fixing portion which are mounted on a board in spaced relation to each other so as to fix a strip-like contact terminal of a predetermined length over a surface of the board, wherein when a distal end portion of the contact terminal is moved in a direction intersecting the surface of the board, the first fixing portion engages the distal end portion to hold the same against disengagement from the board, wherein the second fixing portion comprises a pair of claws formed on and projecting from the board, and when the contact terminal is pivotally moved about the first fixing portion, a proximal end portion of the contact terminal is fitted into a space between the pair of claws, and is held against disengagement from the board, and wherein the contact terminal has limitation means which is engageable with one of the first fixing portion and the second fixing portion so as to limit the movement of the contact terminal in a direction of a length thereof.

The first fixing portion can comprise a construction in which a recessed portion and a projected portion are engaged with each other, and examples thereof include a construction in which an insertion hole is formed in or through the board in a direction parallel to the surface thereof or in a direction of the thickness thereof, and the distal end portion of the contact terminal is inserted in this insertion hole, and a construction in which a hook member, which is engageable in a through-hole formed through the distal end portion of the contact terminal, is formed on and projects from the board.

When the distal end portion of the contact terminal is moved obliquely or perpendicularly relative to the surface of the board, the first fixing portion engages this distal end portion to hold the same against disengagement from the board, and also limits the movement of the distal end portion of the contact terminal in the direction of the width thereof.

On the other hand, the second fixing portion comprises the pair of claws of a substantially inverted L-shape formed on the board, and distal end portions of these claws are tapering, and are opposed to each other.

The claws of this second fixing portion are so elastic that when the proximal end portion of the contact terminal is pressed against the claws, the claws are elastically deformed away from each other to allow this proximal end portion to pass between the distal ends of the claws, and then are restored into their initial condition, so that the claws hold the proximal end portion against disengagement from the board. The movement of this proximal end portion in the direction of the width thereof is limited by the claws.

The limitation means can comprise a construction in which the flanges are formed integrally with and extend from a predetermined portion of the contact terminal in the direction of the width thereof, and the position of formation of these flanges is so determined as to contact the first fixing portion or the second fixing portion.

In this contact terminal fixing construction, the first fixing portion and the second fixing portion limit the movement of the distal end portion and proximal end portion of the contact terminal in the directions of the width and thickness thereof, and the limitation means limits the movement of the contact terminal in the direction of the length thereof.

Namely, in this contact terminal fixing construction, the distal end portion of the contact terminal is first engaged with the first fixing portion, and then the proximal end portion of the contact terminal is fitted in the second fixing portion, and with this very simple operation, the contact terminal can be fixed against movement in the directions of the thickness, width and length thereof without applying a load to the contact terminal in contrast with the conventional construction, and this achieves the above object.

DETAILED DESCRIPTION OF THE PREFERRED EMBODIMENTS

Figure 1:
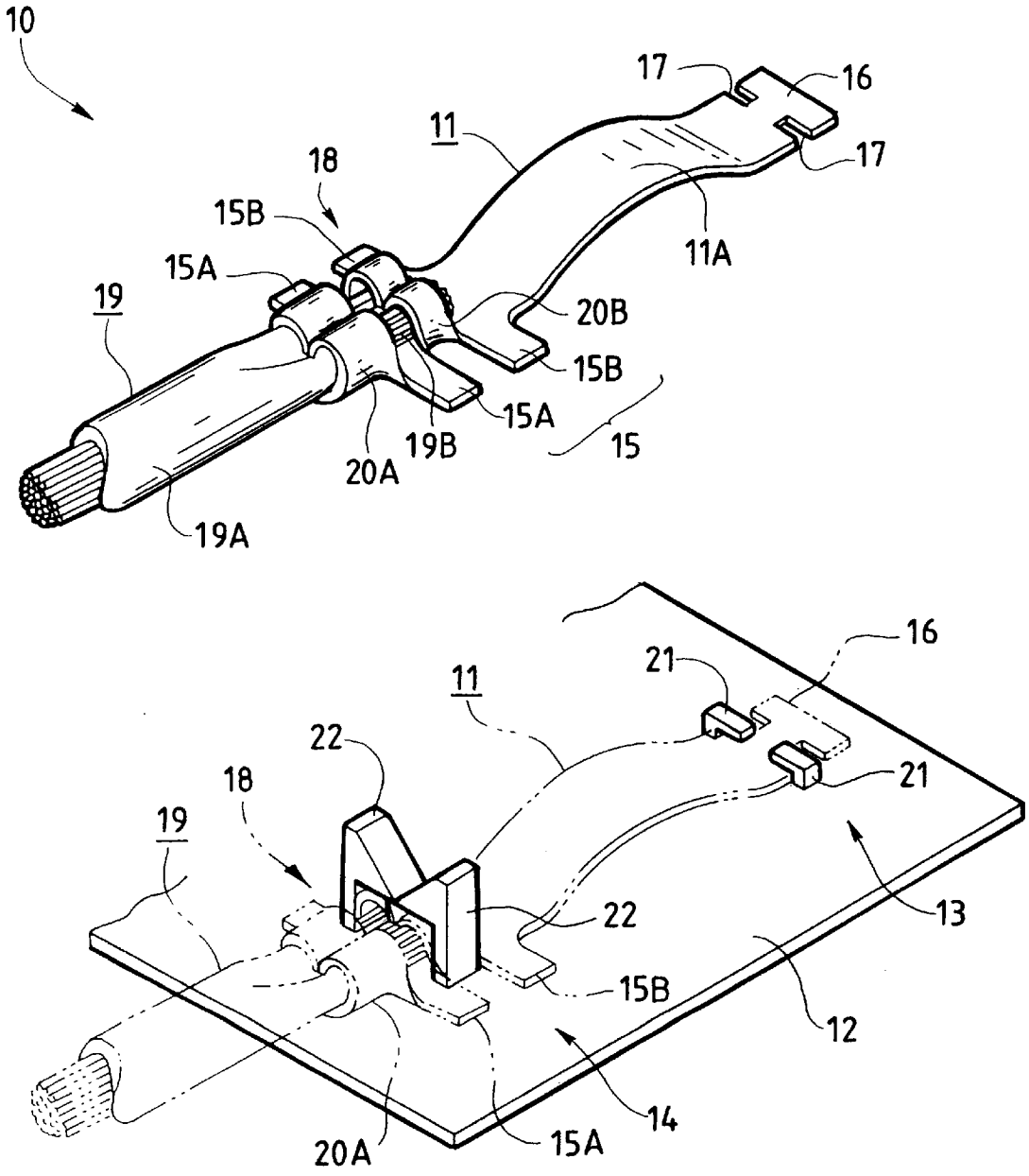
FIG. 1 is a perspective view showing an overall construction of a first embodiment of the present invention.
Figure 3:
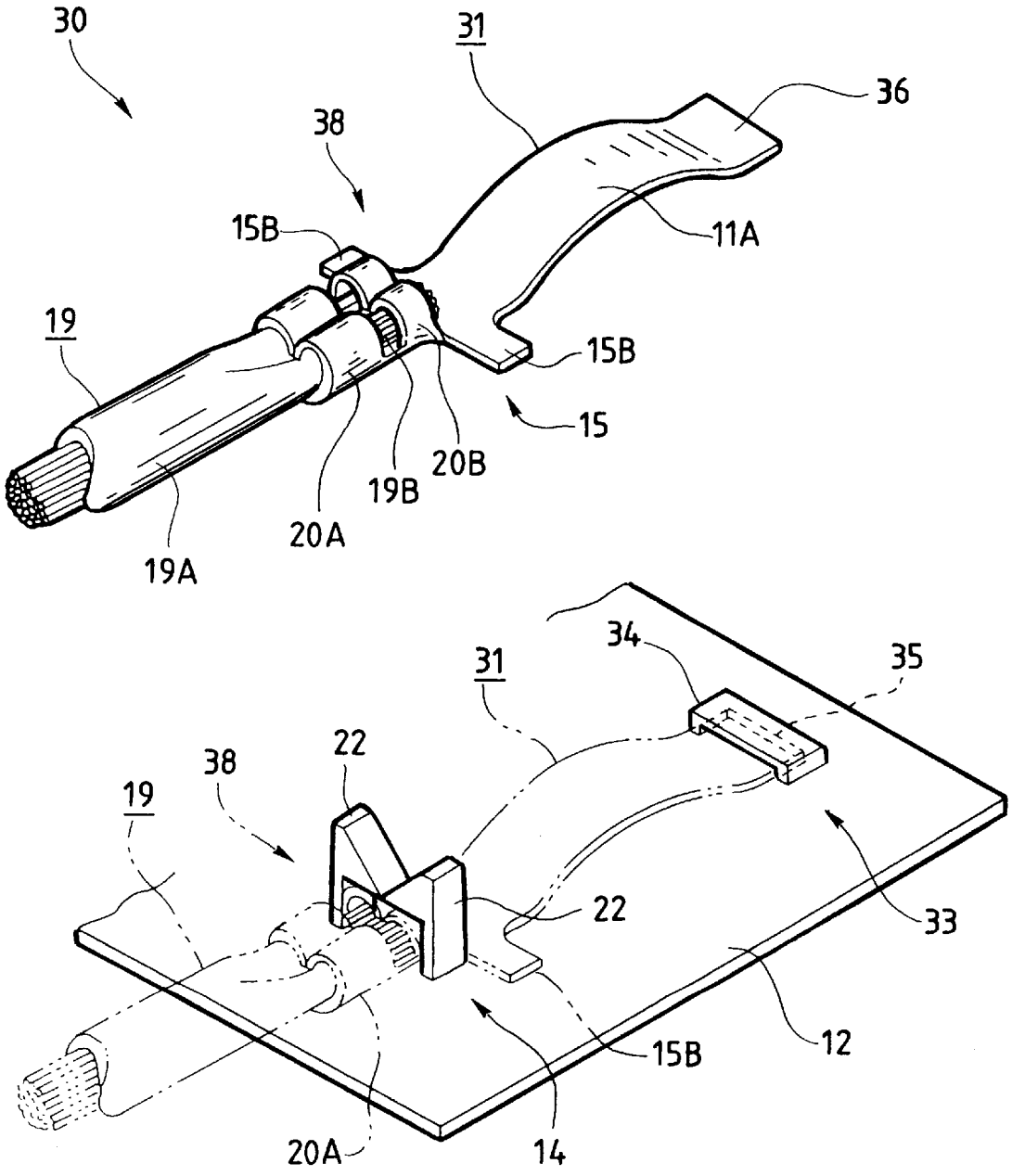
FIG. 3 is a perspective view showing an overall construction of a second embodiment of the invention.
Figure 4:
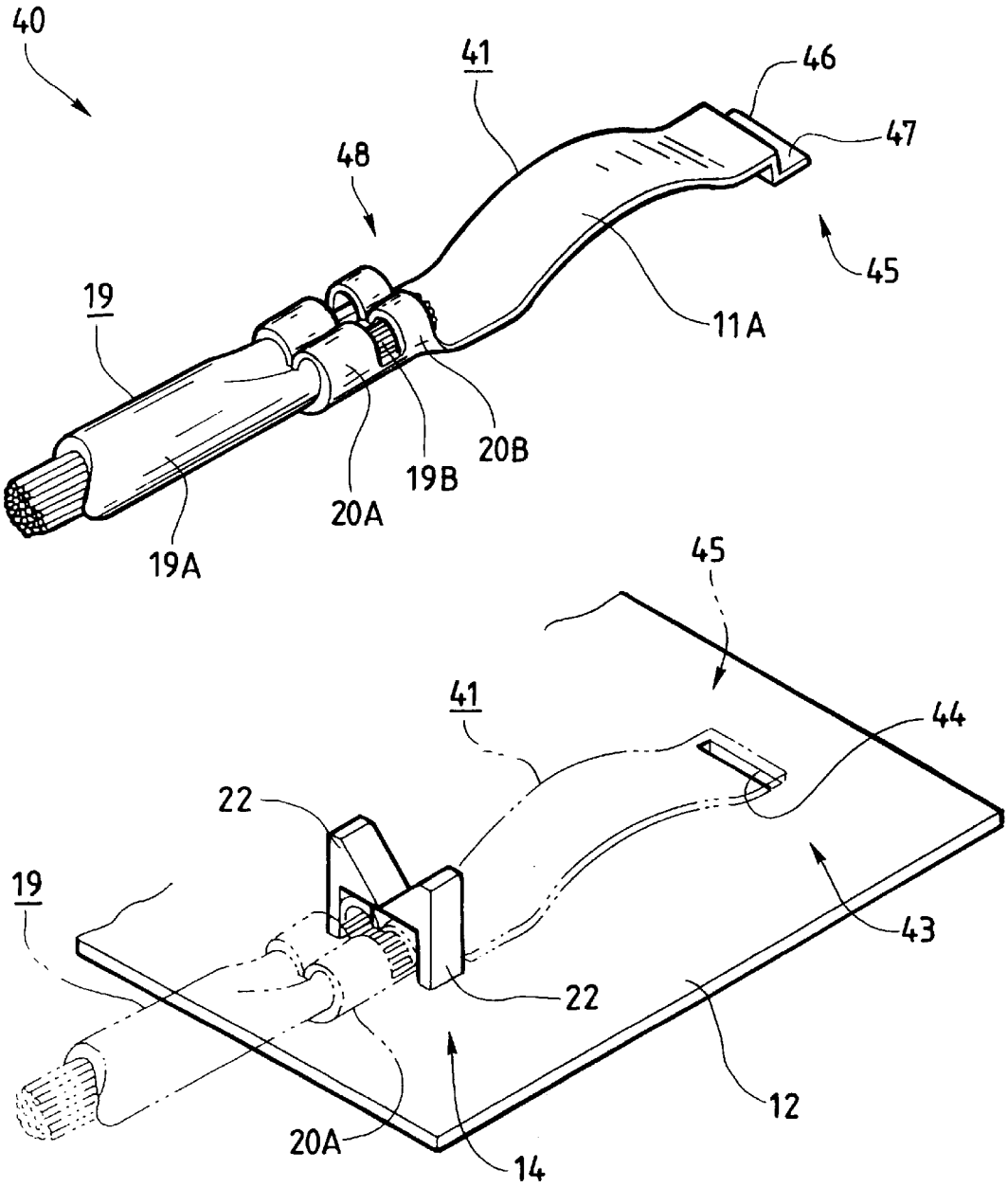
FIG. 4 is a perspective view showing an overall construction of a third embodiment of the invention.
Figure 5:
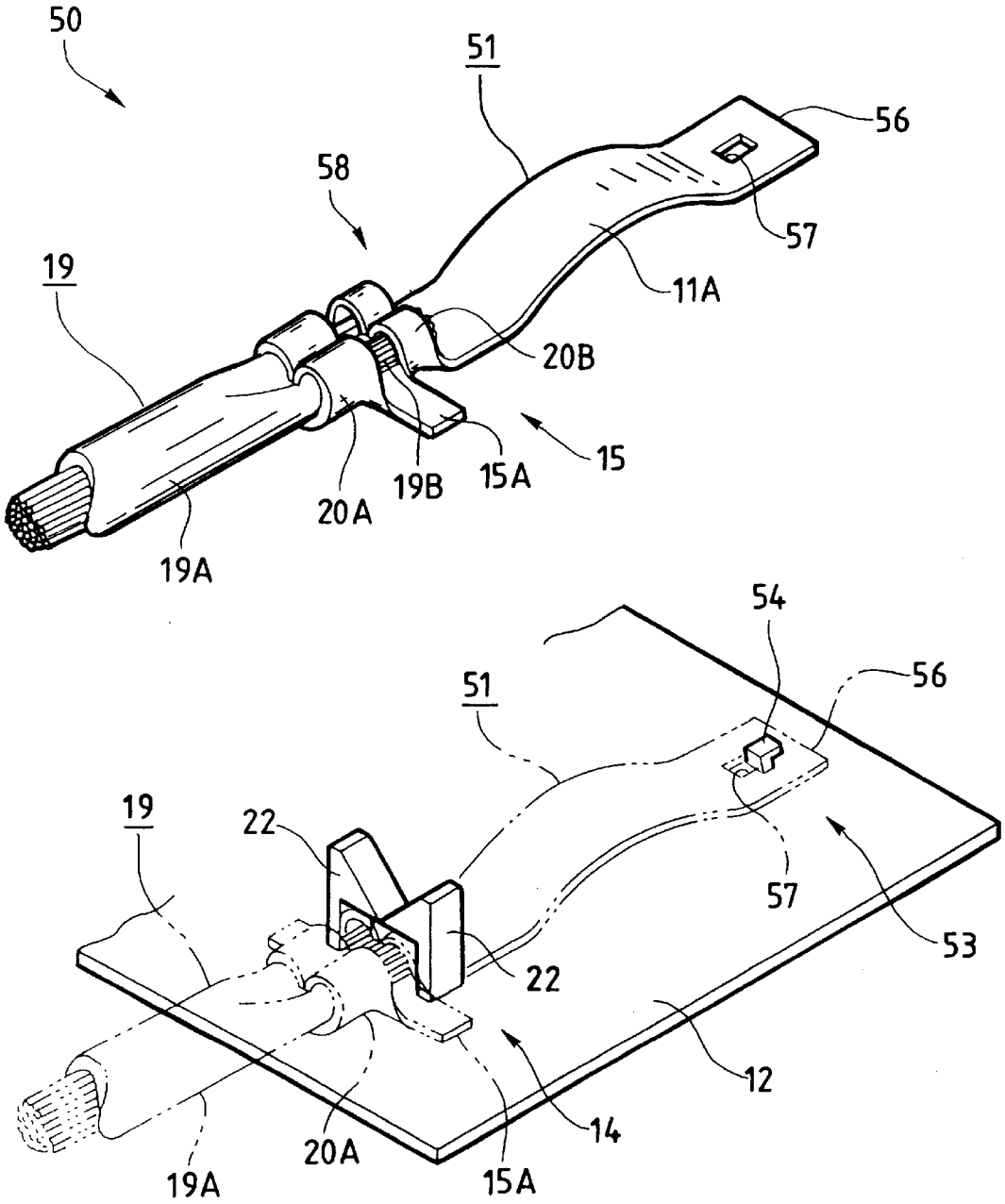
FIG. 5 is a perspective view showing an overall construction of a fourth embodiment of the invention.
Figure 6:
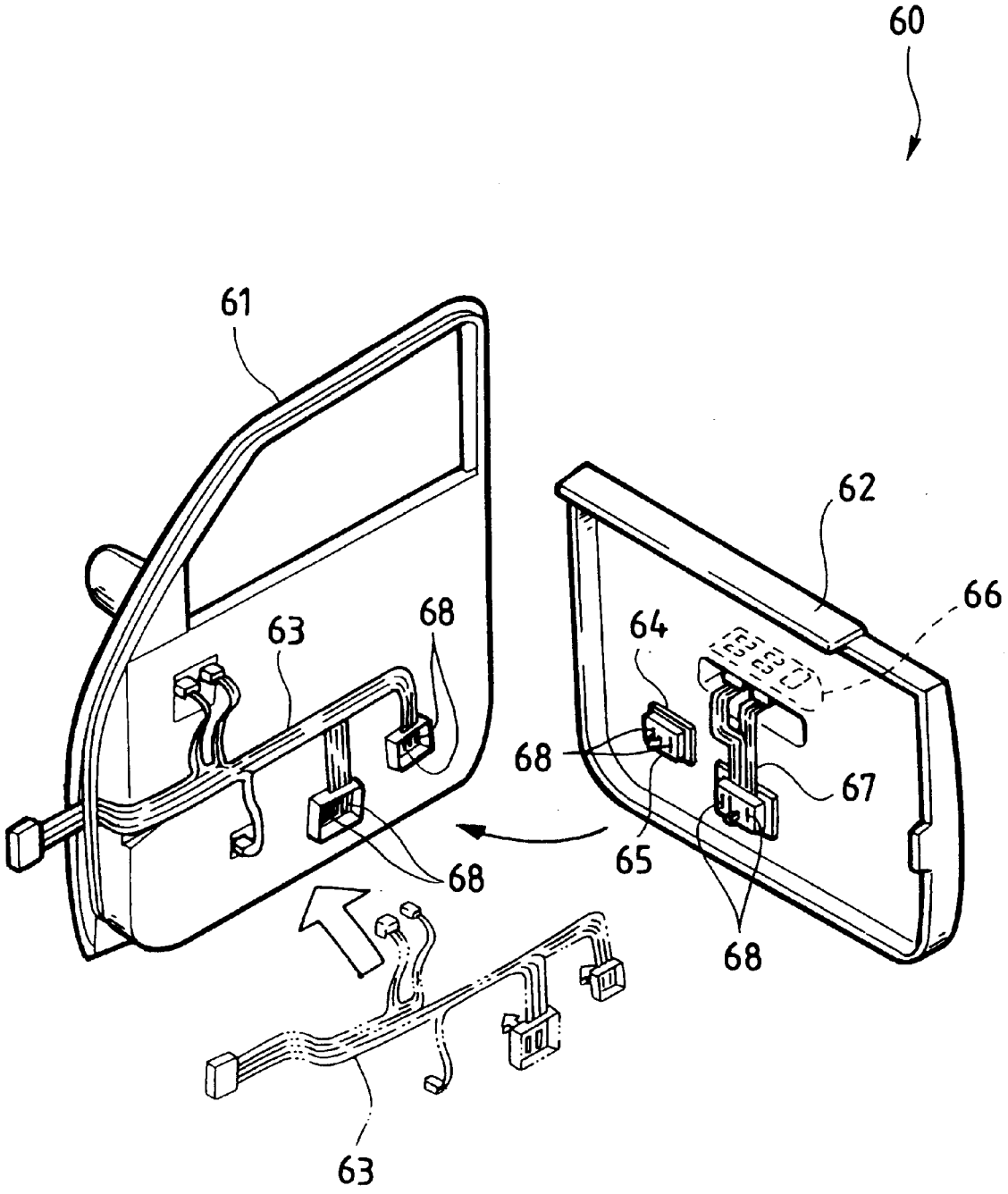
FIG. 6 is an exploded, perspective view of a door of an automobile.
Figure 7A:
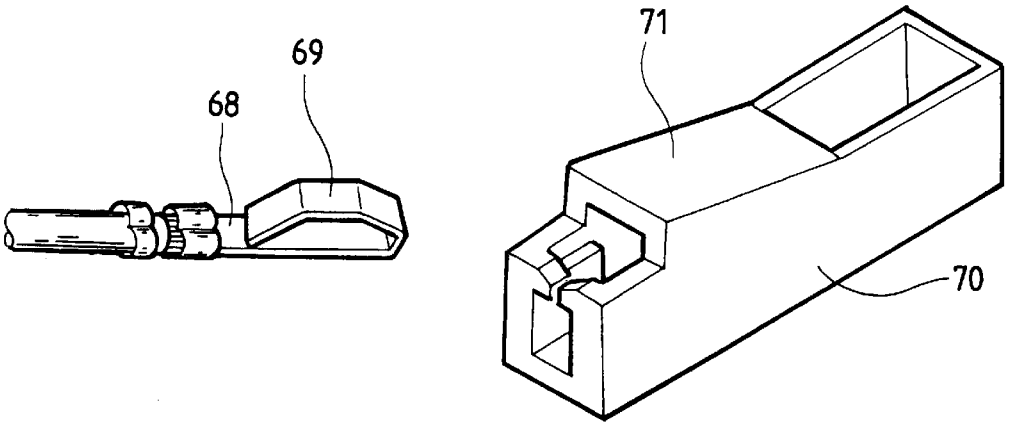
FIG.7(A) PRIOR ART
FIG. 7(A) is a perspective view showing a conventional construction.
Figure 7C:
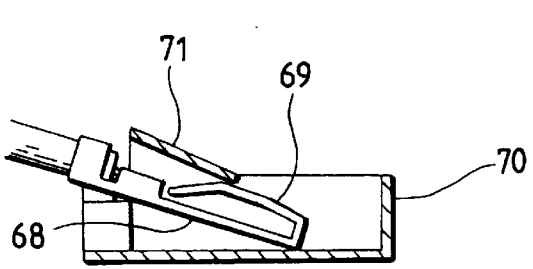
FIG.7(C) PRIOR ART
FIGS. 7(B) and 7(C) are schematic cross-sectional views showing the conventional construction.
Figure 7B:
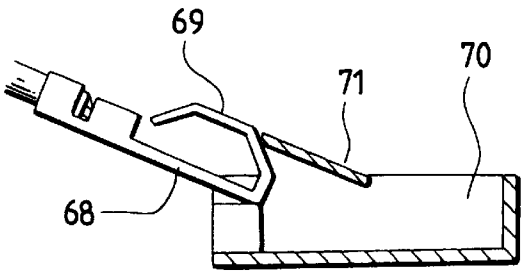
FIG.7(B) PRIOR ART

Preferred embodiments of the present invention will now be described in detail with reference to the drawings. FIG. 1 is a perspective view showing an overall construction of a first embodiment of the invention, FIG. 2 is a schematic side-elevational view showing the operation of the first embodiment, FIG. 3 is a perspective view showing an overall construction of a second embodiment of the invention, FIG. 4 is a perspective view showing an overall construction of a third embodiment of the invention, and FIG. 5 is a perspective view showing an overall construction of a fourth embodiment of the invention.

As shown in FIG. 1, a contact terminal fixing construction 10 of the first embodiment comprises a first fixing portion 13 and a second fixing portion 14, which are mounted on a surface of a board 12 in spaced relation to each other so as to fix a strip-like contact terminal 11 of a predetermined length over the surface of the board 12, and limitation means 15 formed on the contact terminal 11.

The contact terminal 11 is made of suitable metal having electrical conductivity, and has a central portion which is arcuately curved in a direction of its thickness to provide a spring portion 11A. A distal end portion (right end portion in the drawing) 16 of the contact terminal 11 is formed into a substantial T-shape because of the provision of a pair of notches 17 and 17, and clamp portions 20A and 20B for holding a cable 19 are formed at a proximal end portion (left end portion in the drawing) 18 thereof.

The clamp portion 20A bits and holds a sheath 19A of the cable 19, and the clamp portion 20B bits and holds exposed conductors 19B of the cable 19. The clamp portions 20A and 20B are spaced from each other in a direction of a length of the contact terminal 11.

The first fixing portion 13 comprises a pair of retaining members 21 and 21 formed on and projecting from the board 12. The two retaining members 21 and 21 have a substantially inverted L-shape, and are spaced a predetermined distance from each other, with their distal ends opposed to each other.

The dimensions, shape and arrangement of the retaining members 21 and 21 of the first fixing portion 13 are determined in connection with the notches 17 and 17 in the contact terminal 11.

The second fixing portion 14 comprises a pair of claws 22 and 22 formed on and projecting from the board 12. The two claws 22 and 22 have a substantially inverted L-shape, and their opposed distal end portions are tapering, and contact with each other at their tips. The thickness of the claws 22 and 22 is determined in connection with the clamp portion 20B.

The limitation means 15 comprises a pair of first flanges 15A extending respectively from opposite side edges of the contact terminal 11, and a pair of second flanges 15B extending respectively from the opposite sides edges of the contact terminal 11. The first flanges 15A are formed between the clamp portions 20A and 20B, and the second flanges 15B are formed adjacent to the clamp portion 20B.

The first flanges 15A and the second flanges 15B are formed integrally with the contact terminal 11, and can contact the claws 22 and 22 of the second fixing portion 14 in such a manner that the claws 22 and 22 are interposed between the first flanges 15A and the second flanges 15B.

A procedure of fixing the contact terminal 11 to the board 12 will now be described with reference to FIGS. 2(A) to 2(C).

Figure 2A:
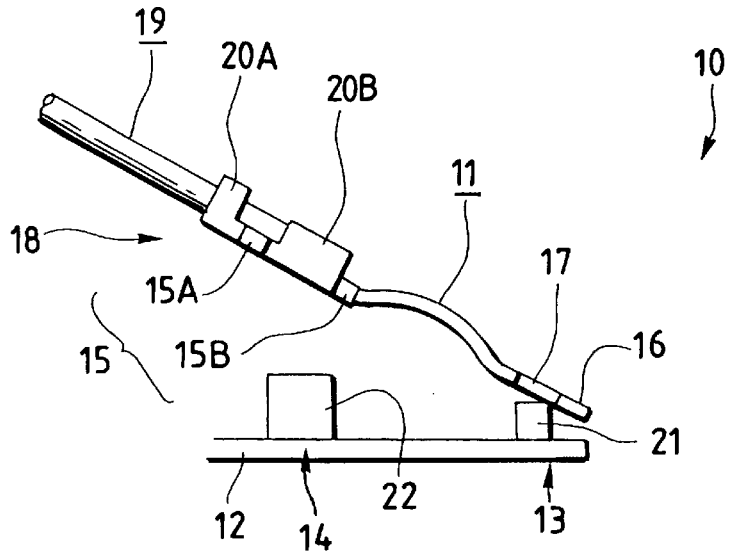
FIGS. 2(A) to 2(C) are schematic side-elevational views showing the operation of the first embodiment.
Figure 2B:
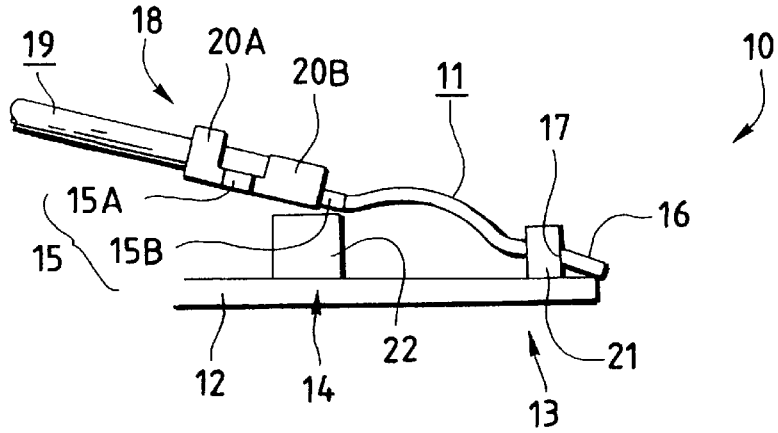

As shown in FIG. 2(A), the operator (not shown) holds the contact terminal 11 in such a manner that the contact terminal 11 is inclined at a predetermined angle relative to the surface of the board 12. Then, as shown in FIG. 2(B), the distal end portion 16 is brought into contact with the board 12 while passing the retaining members 21 and 21 respectively through the notches 17 and 17.

Figure 2C:
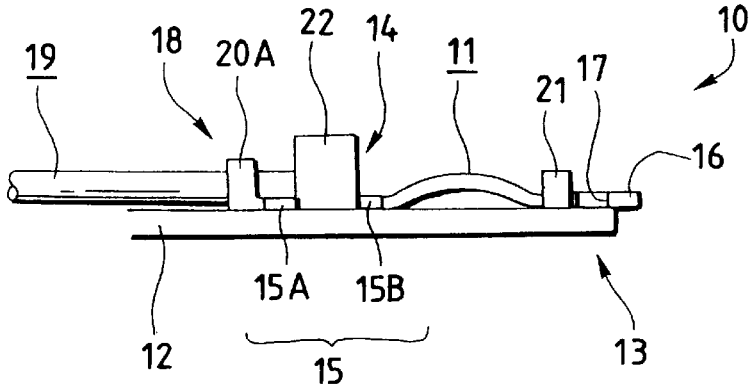

Then, as shown in FIG. 2(C), the contact terminal 11 is slightly moved in a direction, toward which the distal end portion 16 is directed, in such a manner that the notches 17 pass through a space formed by the board 12 and the retaining members 21 and 21, and the contact terminal 11 is pivotally moved counterclockwise (FIG. 2(C)) about the first fixing portion 13, thereby fitting the clamp portion 20B into a space between the claws 22 and 22, thus holding the proximal end portion 18 of the contact terminal 11 against disengagement from the board 12.

In this contact terminal fixing construction 10, the contact terminal 11 is held against disengagement from the board by the first and second fixing portions 13 and 14, and also the movement of the contact terminal 11 in the direction of the length thereof is limited by the first flanges 15A and the second flanges 15B holding the claws 22 and 22 therebetween. Therefore, the contact terminal 11 is positively fixed at a predetermined position relative to the board 12.

In this contact terminal fixing construction, the distal end portion 16 of the contact terminal 11 is engaged in the first fixing portion 13, and then the proximal end portion 18 of the contact terminal 11 is fitted into the space between the claws 22 and 22, and by effecting this very simple operation, the contact terminal 11 can be fixed to the board 12. Therefore, in contrast with the conventional construction, a load will not act on the contact terminal, and besides the mounting of the contact terminal 11 on the board 12 can be simplified.

FIG. 3 shows the second embodiment of the invention. In the embodiments described hereafter, those members, which have already been described above for the embodiment of FIGS. 1 to 2(C), will be designated by identical or like reference numerals, respectively, and description thereof will be simplified or omitted.

In a contact terminal fixing construction 30 of FIG. 3, a distal end portion 36 of a contact terminal 31 has a rectangular shape. A first fixing portion 33 comprises a tunnel-like insertion portion 34 for receiving the distal end portion 36 of the contact terminal 31, and an abutment portion 35 against which the distal end portion 36 of the contact terminal 31 can abut. In this first fixing portion 33, the insertion portion 34 and the abutment portion 35 are formed integrally with each other in such a manner that the abutment portion 35 closes one end of the insertion portion 34.

Limitation means 15 comprises only one pair of flanges 15B disposed adjacent to a clamp portion 20B.

In this contact terminal fixing construction 30, the first fixing portion 33 has the abutment portion 35, and therefore when the distal end portion 36 of the contact terminal 31 is engaged in the first fixing portion 33, the movement of the contact terminal 31 in a direction, toward which the distal end portion 36 is directed, is automatically limited.

Therefore, in this contact terminal fixing construction 30, the limitation means 15 limits only the movement of the contact terminal 31 in a direction toward which its proximal end portion 38 is directed, and therefore the limitation means 15 need only to have the flanges 15B, and the contact terminal 31 can be formed into a simpler shape as compared with the contact terminal of the first embodiment.

FIG. 4 shows the third embodiment of the invention. In a contact terminal fixing construction 40 of FIG. 4, a distal end portion 46 of a contact terminal 41 has a rectangular shape, and is bent in a direction of its thickness to form a bent portion 47 of a substantially crank-like shape.

A first fixing portion 43 is constituted by a through-hole 44 of a substantially rectangular shape formed through a board 12 in a direction of a thickness thereof, and the bent portion 47 of the contact terminal 41 can pass through this through-hole 44.

In this contact terminal fixing construction 40, the operator holds the contact terminal 41 in such a manner that the contact terminal 41 is disposed substantially perpendicular to the surface of the board 12, and then the bent portion 47, defined by the distal end portion 46 of the contact terminal, is passed or inserted through the through-hole 44 until a step portion of this bent portion 47 is brought into contact with the surface of the board 12. Then, the contact terminal 41 is pivotally moved about the first fixing portion 43, thereby engaging its proximal end portion 48 in a second fixing portion 14. As a result, the distal end portion 46 of the contact terminal 41 is held against disengagement from the board 12, and also the step portion of the bent portion 47 contacts the inner surface of the through-hole 44, thereby limiting the movement of the contact terminal 41 in a direction of a length thereof. Thus, this step portion serves as limitation means 45.

Therefore, in this contact terminal fixing construction 40, there is no need to provide any flanges as described above for the first and second embodiments, and the shape of the contact terminal can be more simplified.

FIG. 5 shows the fourth embodiment of the invention. In a contact terminal fixing construction 50 of FIG. 5, a distal end portion 56 of a contact terminal 51 has a rectangular shape, and an engagement hole 57 is formed through this distal end portion in a direction of a thickness thereof.

A first fixing portion 53 comprises a hook member 54 of a substantially inverted L-shape formed on and projecting from a board 12, and a distal end of the hook member 54 is directed in a direction away from a second fixing portion 14.

In this contact terminal fixing construction 50, the distal end portion 56 of the contact terminal 51 is engaged with the first fixing portion 53, with the hook member 54 passed through the engagement hole 57, and then the contact terminal 51 is slightly moved in a direction toward which its proximal end portion 58 is directed, and the contact terminal 51 is pivotally moved about the first fixing portion 53, thereby engaging the proximal end portion 58 with the second fixing portion 14. Also in this contact terminal fixing construction 50, effects as achieved in the above first, second and third embodiments can be obtained.

The contact terminal fixing construction of the present invention is not limited to the above embodiments, and for example, the material, shape, dimensions, form, number, arrangement and etc., of the contact terminal, the board, the first fixing portion, the second fixing portion, the claws, the limitation means, the flanges, the retaining members, the notches, the insertion portion, the abutment portion, the hook member, the engagement hole and so on can be suitably modified in so far as the present invention can be achieved.

As described above, in the present invention, by effecting the very simple operation in which the distal end portion of the contact terminal is first engaged with the first fixing portion, and then the proximal end portion of the contact terminal is fitted into the second fixing portion, the contact terminal can be fixed against movement in the directions of the thickness and width thereof without applying a load to the contact terminal in contrast with the conventional construction.

What is claimed is:

1. A contact terminal fixing construction comprising a first fixing portion and a second fixing portion which are mounted on a board in spaced relation to each other so as to fix a strip-like contact terminal of a predetermined length over a surface of the board, wherein when a distal end portion of said contact terminal is moved in a direction intersecting the surface of the board, said first fixing portion engages the distal end portion to hold the same against disengagement from the board, wherein said second fixing portion comprises a pair of claws formed on and projecting from the board, and when said contact terminal is pivotally moved about said first fixing portion, a proximal end portion of said contact terminal is fitted into a space between the pair of claws, and is held against disengagement from the board, and wherein said contact terminal has limitation means which is engageable with one of said first fixing portion and said second fixing portion so as to limit the movement of said contact terminal in a direction of a length thereof.

2. The contact terminal fixing construction according to claim 1, wherein said limitation means has a flange extending from said contact terminal in a direction of a width thereof, and the flange is engageable with the claw.

3. The contact terminal fixing construction according to claim 1, wherein said first fixing portion comprises a pair of retaining members of a substantially inverted L-shape formed on and projecting from the board, and distal ends of the pair of retaining members are opposed to each other, and a pair of notches, corresponding respectively to the pair of retaining members, are formed in said contact terminal.

4. The contact terminal fixing construction according to claim 1, wherein said first fixing portion comprises a tunnel-like insertion portion for receiving the distal end portion of said contact terminal, and an abutment portion against which the distal end portion of said contact terminal can abut.

5. The contact terminal fixing construction according to claim 1, wherein said first fixing portion has a through-hole formed through the board, and the distal end portion of said contact terminal is bent in a direction of its thickness to form a bent portion of a crank-like shape.

6. The contact terminal fixing construction according to claim 1, wherein said first fixing portion comprises a hook member of a substantially inverted L-shape formed on and projecting from the board, and a distal end of the hook member is directed in a direction away from said second fixing portion, and an engagement hole, corresponding to the hook member, is formed through the distal end portion of said contact terminal.

* * * * *